US008800759B2

(12) United States Patent
Billiet-Prades et al.

(10) Patent No.: US 8,800,759 B2
(45) Date of Patent: Aug. 12, 2014

(54) BUSHING FOR RECEIVING A DROPPER NECK, AND CORRESPONDING PACKAGE AND KIT

(71) Applicant: Sanofi-Aventis, Paris (FR)

(72) Inventors: Yves Billiet-Prades, Madrid (ES); Felipe Sanchez Cifuentes, Coslada (ES); Ricardo Perez Lopez, Madrid (ES)

(73) Assignee: Sanofi-Aventis (FR)

( * ) Notice: Subject to any disclaimer, the term of this patent is extended or adjusted under 35 U.S.C. 154(b) by 0 days.

(21) Appl. No.: 13/929,989

(22) Filed: Jun. 28, 2013

(65) Prior Publication Data

US 2013/0284316 A1 Oct. 31, 2013

Related U.S. Application Data

(62) Division of application No. 12/085,634, filed as application No. PCT/EP2006/068806 on Nov. 23, 2006.

(30) Foreign Application Priority Data

Nov. 25, 2005 (FR) ..... 05 11943

(51) Int. Cl.
*B65D 81/32* (2006.01)

(52) U.S. Cl.
USPC ..... 206/219; 141/366

(58) Field of Classification Search
USPC ..... 141/319, 366; 215/355; 206/219
See application file for complete search history.

(56) References Cited

U.S. PATENT DOCUMENTS

| | | | | |
|---|---|---|---|---|
| 47,238 | A | | 11/1865 | Whitall |
| 837,408 | A | | 12/1906 | Johnstone |
| 1,481,085 | A | | 1/1924 | Duchatelet |
| 1,728,965 | A | | 9/1929 | Hein |
| 1,793,048 | A | | 2/1931 | Brigel |
| 2,957,609 | A | * | 10/1960 | Holmes ..... 222/212 |
| 4,573,506 | A | | 3/1986 | Paoletti |
| 4,986,322 | A | | 1/1991 | Chibret et al. |
| 5,027,872 | A | | 7/1991 | Taylor et al. |

FOREIGN PATENT DOCUMENTS

ES 2078194 12/1995

OTHER PUBLICATIONS

International Search Report, PCT/EP2006/068806 dated Feb. 8, 2007.

* cited by examiner

*Primary Examiner* — David Sorkin
(74) *Attorney, Agent, or Firm* — Lerner, David, Littenberg, Krumholz & Mentlik, LLP

(57) ABSTRACT

A bushing for the preparation of a suspension or solution formed by mixing a first product with a second product, to allow a first bottle initially containing the first product to communicate with a second bottle initially containing the second product is provided.

11 Claims, 3 Drawing Sheets

BUSHING FOR RECEIVING A DROPPER NECK, AND CORRESPONDING PACKAGE AND KIT

CROSS-REFERENCE TO RELATED APPLICATIONS

The present application is a divisional of U.S. patent application Ser. No. 12/085,634, filed on Sep. 16, 2009, which application is a national phase entry under 35 U.S.C. §371 of International Application No. PCT/EP2006/068806 filed Nov. 23, 2006, which claims priority from French Application No. 0511943, filed Nov. 25, 2005.

FIELD OF THE INVENTION

The invention relates to a bushing intended for the extemporaneous preparation of a suspension or solution formed by mixing a first product with a second product, to allow a first bottle initially containing the first product to communicate with a second bottle initially containing the second product.

The invention also relates to a package comprising said bushing and a kit comprising said bushing.

BACKGROUND OF THE INVENTION

The present invention relates to improvements to packaging assemblies intended for the extemporaneous preparation of suspensions or solutions of an active product.

FIGS. 1 and 2 show a known prior art assembly.

Said assembly consists of two main parts.

First, the assembly contains two hermetically sealed bottles A and B. The first of these bottles A is intended to contain a first active product, generally in dry powder form. The second bottle is intended to contain a second product, generally a liquid in which the active product is to be placed in solution or suspension at the time it is administered.

Second, the assembly comprises linking means to place the two bottles A and B in communication, for the purpose firstly of adding the liquid to the first bottle, and secondly of aspirating the solution or suspension thus formed into the second bottle.

For this purpose, the second bottle B, made in flexible material, is inverted and screwed into a bushing 1 of the first bottle A. This bushing 1 comprises an upper part 2, having an inner thread 4, and a lower part 3 having an inner shoulder 5.

The second bottle B ends in a dropper 6, joined to the body 7 by a shoulder 8 having an outer thread.

Also, bottle A, generally in glass, is closed by a stopper 9 in elastomeric material, through which a hole 10 passes, that is sealed by a protective membrane 11 that can be perforated. The membrane is made in aluminium for example.

When bottle B is screwed onto bottle A by matching the threads 4 and 8, the dropper 6 comes to perforate the membrane 11 and enters into the hole 10 thereby placing the two bottles in communication.

The joining of the two bottles is made via the single part 1, this part being secured to bottle A by press-fitting the shoulder 5 onto a neck of bottle A.

To facilitate centering and preparation of the components relative to each other, provision is made to place vertical ridges 13 around the neck of bottle A below a press-fit collar 12 called a "bead". Initial press-fitting of 5 is made temporarily on the bead 12 and then the bushing is pushed down onto the neck, final press-fitting being achieved below the bead 12 as can be seen FIG. 1. These provisions are made to facilitate mounting of the bushing 1 onto the stopper 9 and bottle A, and to achieve less costly assembly. The neck of bottle A generally has two press-fit collars.

Said assembly has several drawbacks.

First, the neck of the bottle has two collars 12 which may hamper fixing of the bushing 1 onto the bottle A. Also, the two collars and the ridges are not optimal in terms of quantity of material used to manufacture the bottle.

Secondly, the stopper 9 in elastomeric material and the sealing membrane 11 to be perforated are not optimal either, since they consist of parts separate from one another and separate from the bushing. Fixing of the stopper, membrane and bushing require difficult centering.

For all these reasons, the cost price of the parts and assembly time are relatively high.

SUMMARY OF THE INVENTION

The invention targets a novel embodiment, of the bushing in particular, which overcomes all these drawbacks through simplification of the aforementioned parts.

For this purpose the invention proposes a bushing intended for the extemporaneous preparation of a suspension or solution formed by mixing a first product and a second product, enabling a first bottle initially containing the first product to be placed in communication with a second bottle initially containing the second product, the second bottle being provided with a dropper neck, the placing in communication of the first bottle and second bottle being made firstly for the purpose of adding the second product to the first bottle and secondly of suctioning the suspension or solution thus formed into the second bottle via the dropper, characterized in that the bushing has an inside receptacle to receive the dropper neck, the shape of the receptacle mating with the dropper neck.

The invention is advantageously completed by the following characteristics, taken alone or in any technically possible combination.

The bushing comprises a body having an upper portion intended to cooperate with part of the dropper neck of the second bottle, and a lower portion able to cap a neck of the first bottle.

A section of the receptacle varies by decreasing from the upper portion towards the lower portion so that it can match and cooperate with the dropper neck.

The bushing also has a stopper whose shape matches the receptacle, the shape of the stopper thereby being similar to the shape of the dropper neck.

The stopper is removable from the body.

The upper portion of the bushing has an inner thread so that it can be coupled by screwing onto a thread at the base of the dropper neck or a thread of a base of a stopper.

The lower portion of the bushing has an inner shoulder intended to press-fit, by clipping on a circular collar, onto a neck of the first bottle.

The bushing also has a cap able to cooperate with an outer part of the body.

The cap is also able to cooperate with an inner part of the stopper.

The cap is removable from the body and/or a stopper.

The bushing is made of moulded plastic material.

The invention also relates a package comprising said bushing and a kit comprising said bushing.

The invention has numerous advantages.

The securing of the bushing onto the glass bottle is easier. Less glass is used to manufacture the bottle, which generates a lower cost price.

Fewer component parts are needed for the assembly. In particular no elastomeric stopper and no membrane are required. The cost price and mounting time of the assembly are consequently reduced.

BRIEF DESCRIPTION OF THE DRAWINGS

Other characteristics, purposes and advantages of the invention will become apparent from the following description given purely by way of illustration and which is non-limiting, and is to be read with reference to the appended drawings in which.

DETAILED DESCRIPTION OF PREFERRED EMBODIMENTS

FIGS. 4*a*, 4*b*, 5, 7 and 9 schematically illustrate a bushing 190 intended for the extemporaneous preparation of a suspension or solution formed by mixing a first product with a second product.

Figure 1:
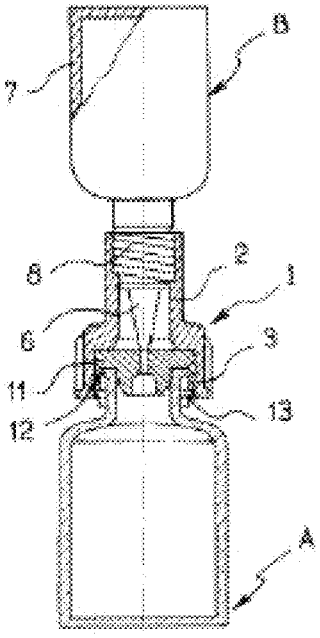
PRIOR ART FIG.1
FIGS. 1 and 2 illustrate an axial section of a known prior art assembly.
Figure 2:
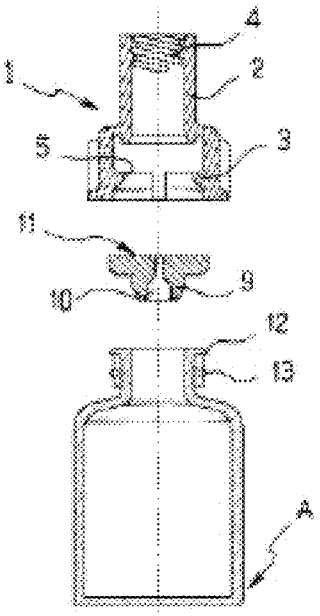
PRIOR ART FIG.2
Figure 3:
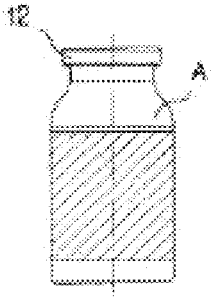
FIG. 3 illustrates a first bottle according to one embodiment of the invention.
Figure 5:
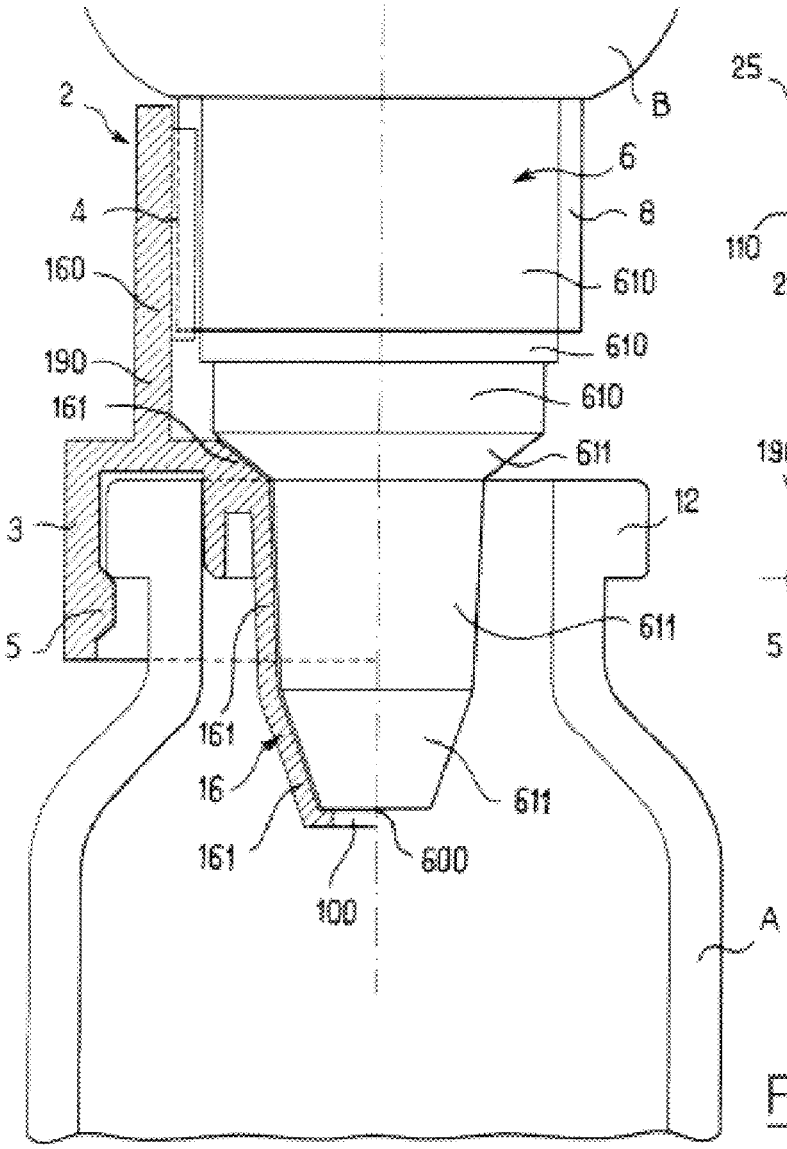
FIG. 5 shows a cross-sectional view in which a bushing according to one embodiment of the invention cooperates with a dropper neck.
Figure 6:
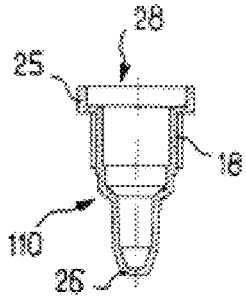
FIG. 6 shows an axial cross-sectional view of a stopper according tone embodiment of the invention.

The bushing 190 enables a first bottle A which can be seen in FIG. 3, to be placed in communication with a second bottle B, which can be seen in FIG. 5 and is identical to the bottle B in FIGS. 1 and 2.

The first bottle A initially contains the first product. The first product is preferably a solid, active product in dry, freeze-dried powder form.

The second bottle B initially contains the second product. The second product is preferably a liquid product.

The second bottle B is provided with a dropper neck 6.

The placing in communication of the first bottle A with the second bottle B via the bushing 190 is achieved conventionally for the purpose firstly of adding the second product to the first bottle A, and secondly of aspirating the suspension or solution thus formed into the second bottle B.

Adding and aspiration is made via the dropper neck 6. FIG. 5 shows that the dropper neck 6, at its distal end, has an orifice 600 allowing passing of the products.

The bushing 190 has an inside receptacle 16 to receive the dropper neck 6. The shape of the receptacle 16 matches the shape of the dropper neck 6. The receiving of the dropper neck 6 in the receptacle 16 of matching shape enables good cooperation of the dropper neck 6 with the receptacle, preventing any leakage of the first product or second product during adding or aspiration, and ensures aseptic conditions.

A hole 100 made in a bottom wall 27 of the receptacle 16 is able to cooperate with the orifice 600 when the dropper neck is in position in the receptacle 16. Owing to the cooperation between the shape of the dropper neck 6 and the shape of the receptacle 16, the orifice 600 comes to lie opposite the hole 100, thereby preventing leakage of the first product and of the second product during adding or aspiration and complies with asepsis conditions.

The bushing 190 comprises mainly a body 191.

The body 191 has an upper portion 2 intended to cooperate with part of the dropper neck 6 of the second bottle B. The body 191 has a lower portion 3 able to cap a neck of the first bottle A.

Preferably, one section of the receptacle 16 varies by decreasing from the upper portion 2 towards the lower portion 3 so as to cooperate by matching with the dropper neck 6.

Figure 4A:
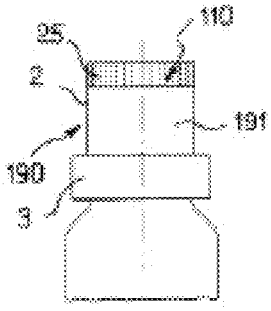
FIG. 4*a* shows a front view of a bushing according to one embodiment of the invention.
Figure 4B:
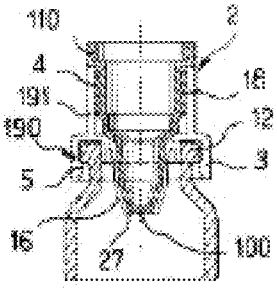
FIG. 4*b* shows a cross-sectional view of a bushing according to one embodiment of the present invention.
Figure 7:
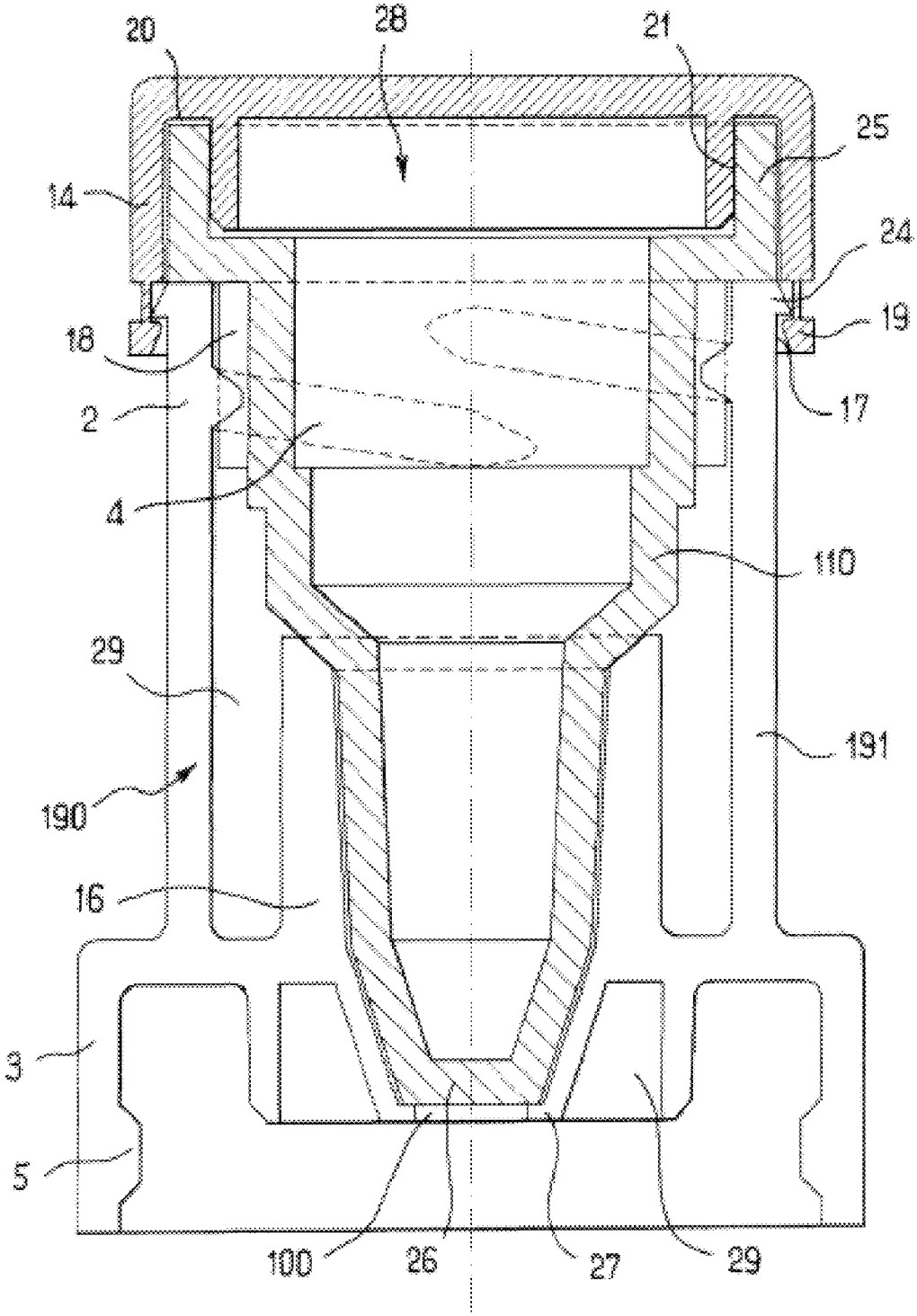
FIG. 7 shows an axial cross-sectional view of a bushing according to another embodiment of the invention.

FIGS. 4*b*, 5 and 7 particularly show that the receptacle 16 comprises straight cylindrical sections 160 to cooperate by matching with straight cylindrical sections 610 of the dropper neck 6. The receptacle 16 comprises conical cylindrical sections 161 to cooperate by matching with conical cylindrical sections 611 of the dropper neck 6. The succession of straight 160 and conical 161 cylindrical sections is such that the section of the receptacle 16 decreases from the upper portion 2 towards the lower portion 3.

As shown in FIGS. 4*a* and 4*b*, the bushing 190 also comprises a stopper 110 whose shape matches the shape of the receptacle 16. The shape of the stopper is therefore similar to the shape of the dropper neck 6.

As shown in FIG. 4*b*, the cooperation between the stopper 110 and the receptacle 16 is such that when the stopper 110 is in place in the receptacle 16, the hole 100 of the receptacle is fully sealed by the bottom wall 26 of the stopper 110. The receiving of the stopper 110 in the receptacle 16 of mating shape allows good cooperation between the stopper 110 and the receptacle 16 thereby preventing any leakage of the first product and complying with asepsis conditions.

Evidently, the stopper 110 is removable from the receptacle 16, and preferably from the body 191.

The upper potion 2 of the bushing 190 comprises an inner thread 4 so that it can be coupled by screwing to a thread 8 of a base of the dropper neck 6.

The thread 4 may also be coupled by screwing to a thread 18 of a base of the stopper 110.

The lower portion 3 of the bushing 190 has an inner shoulder 5 intended to press-fit, by latching a circular collar 12, onto a neck of the first bottle A.

Most preferably, the first bottle A only has a single collar 12. The quantity of glass used is therefore lower than the quantity of glass used for prior art bottles.

Figure 9:
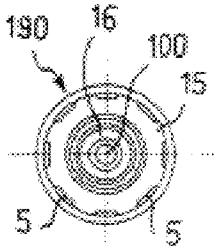
FIG. 9 shows an underside bottom view of a bushing according to another embodiment of the invention.

As shown in FIG. 9, it is possible that the shoulder may not be continuous and may comprise notches 15.

The notches 15 are intended to achieve further savings in material, this time for the bushing 190, whilst facilitating assembly of the bushing 190 onto the bottle A.

Similarly, FIG. 7 shows that the bushing 190 may comprise cut-outs 29 to achieve savings in material used to manufacture the bushing.

As shown in FIGS. 4*b* and 7, the stopper 110 is preferably hollow, with part 28, opposite the bottom wall 26, being open. In this manner further savings in material are achieved to manufacture the stopper 110.

Figure 8A:
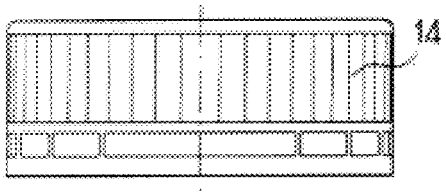
FIG. 8*a* shows a front view of a cap according to one embodiment of the invention.
Figure 8B:
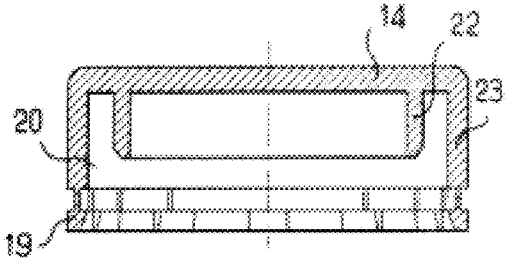
FIG. 8*b* shows an axial cross-sectional view of a cap according to one embodiment of the invention.

FIGS. 8*a* and 8*b* show that the bushing 190 may then also comprise a cap 14 able to cooperate with an outer part 17 of the body 191.

Therefore the upper part 2 of the body 191 may comprise patterns, in lug or saw tooth shape 24, able to cooperate with matching shoulders 19 on the cap 14.

The cap 14 may also be able to cooperate with an inner part 21 of the stopper 110.

Therefore an upper part of the stopper 25 is housed in a cut-out 20 lying between an inner wall 22 and an outer wall 23 of the cap 14.

Cap 14 is evidently removable from the body 191 and/or from the stopper 110.

FIG. 4*a* shows that the upper part 25 of the stopper 110 has a grasp pattern to facilitate screwing and unscrewing of the stopper 110 in the bushing.

Most preferably, the body 191, the stopper 110 and the cap 14 are in moulded plastic material, each in a single piece. This provides savings in material and assembly time.

The invention also relates a package comprising a bottle of type A including a bushing according to the invention, and a kit comprising a package according to the invention and a bottle of type B.

Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

The invention claimed is:

1. A kit for the preparation and aspiration of a suspension or solution formed by mixing a first product with a second product, the kit comprising:

a first bottle containing the first product;

a second bottle containing the second product, the second bottle having a dropper neck; and a bushing distinct from the first and second bottles having a receptacle configured to attach to the first bottle and receive the dropper neck, wherein the receptacle has a shape that matches with a shape of the dropper neck, the bushing further including a stopper and a cap, the stopper configured to cooperate with the receptacle, the stopper having a shape that matches with the shape of the receptacle, the shape of the stopper being similar to the shape of the dropper neck and having a closed bottom end that seals the receptacle and prevents transfer of material from the dropper neck to the receptacle when the stopper is mated to the receptacle, wherein the cap has an inner wall, an outer wall, and a cut-out between the inner wall and the outer wall, an upper part of the stopper configured to be housed in the cut-out.

2. The kit according to claim 1, wherein the first product is a solid and the second product is a liquid.

3. The kit of claim 1, wherein the bushing includes a body having an upper portion for cooperating with part of the dropper neck of the second bottle, and a lower portion for capping a neck of the first bottle.

4. The kit of claim 3, wherein a section of the receptacle decreases from the upper portion towards the lower portion for cooperating with the dropper neck.

5. The kit according to claim 3, wherein the stopper is removable from the body.

6. The kit of claim 3, wherein the upper portion is threaded, for threadably engaging with the dropper neck or with the stopper.

7. The kit of claim 3, wherein an inner portion of the bushing has an inner shoulder for press-fitting onto a neck of the first bottle.

8. The kit of claim 3, wherein the cap cooperates with an outer part of the body.

9. The kit of claim 3, wherein the cap cooperates with an inner part of the stopper.

10. The kit of claim 9, wherein the cap is removable from the body or from the stopper.

11. The kit of claim 2, wherein the bushing is made of molded plastic material.

* * * * *